US010968639B2

(12) United States Patent
Pervan et al.

(10) Patent No.: US 10,968,639 B2
(45) Date of Patent: Apr. 6, 2021

(54) MECHANICAL LOCKING SYSTEM FOR FLOOR PANELS

(71) Applicant: CERALOC INNOVATION AB, Viken (SE)

(72) Inventors: Darko Pervan, Viken (SE); Tony Pervan, Stockholm (SE)

(73) Assignee: CERALOC INNOVATION AB, Viken (SE)

( * ) Notice: Subject to any disclaimer, the term of this patent is extended or adjusted under 35 U.S.C. 154(b) by 65 days.

(21) Appl. No.: 16/224,951

(22) Filed: Dec. 19, 2018

(65) Prior Publication Data

US 2019/0119928 A1 Apr. 25, 2019

Related U.S. Application Data

(63) Continuation of application No. 15/175,768, filed on Jun. 7, 2016, now Pat. No. 10,180,005, which is a (Continued)

(51) Int. Cl.

| | |
|---|---|
| ***E04F 15/02*** | (2006.01) |
| ***E04B 5/02*** | (2006.01) |
| ***E04F 13/08*** | (2006.01) |

(52) U.S. Cl.

CPC ..... *E04F 15/02038* (2013.01); *E04B 5/02* (2013.01); *E04F 13/0894* (2013.01); (Continued)

(58) Field of Classification Search

CPC ..... E04F 15/10; E04F 15/107; E04F 15/02; E04F 15/02005; E04F 15/02038; (Continued)

(56) References Cited

U.S. PATENT DOCUMENTS

| | | | |
|---|---|---|---|
| 87,853 | A | 3/1869 | Kappes |
| 108,068 | A | 10/1870 | Utley |

(Continued)

FOREIGN PATENT DOCUMENTS

| | | |
|---|---|---|
| CN | 201588375 U | 9/2010 |
| CN | 201110035241.6 | 1/2011 |

(Continued)

OTHER PUBLICATIONS

U.S. Appl. No. 16/713,373, Roger Ylikangas, Karl Quist, Anders Nilsson and Caroline Landgård, filed Dec. 13, 2019.

(Continued)

*Primary Examiner* — William V Gilbert

(74) *Attorney, Agent, or Firm* — Buchanan Ingersoll & Rooney P.C.

(57) ABSTRACT

Floor panels are shown, which are provided with a vertical locking system on short edges including a displaceable tongue that is displaced in one direction into a tongue groove during vertical displacement of two panels. Building panels provided with a locking system for vertical locking of a first and a second building panel by a vertical displacement of the panels relative each other, a displaceable tongue is in a sidewardly open displacement groove provided at an edge of a first panel, said tongue cooperates with a tongue groove provided at an adjacent edge of a second panel for locking the edge and the adjacent edge vertically.

17 Claims, 8 Drawing Sheets

Related U.S. Application Data continuation of application No. 14/701,959, filed on May 1, 2015, now Pat. No. 9,388,584, which is a continuation of application No. 14/483,352, filed on Sep. 11, 2014, now Pat. No. 9,051,738, which is a continuation of application No. 13/585,179, filed on Aug. 14, 2012, now Pat. No. 8,857,126.

(60) Provisional application No. 61/523,584, filed on Aug. 15, 2011.

(52) U.S. Cl.
CPC . *E04F 2201/0138* (2013.01); *E04F 2201/049* (2013.01); *E04F 2201/0547* (2013.01); *Y10T 428/167* (2015.01)

(58) Field of Classification Search
CPC ..... E04F 2201/03; E04F 2201/04; E04F 2201/041; E04F 2201/042; E04F 2201/043; E04F 2201/044; E04F 2201/045; E04F 2201/046
USPC ..... 52/578, 592.1, 592.3, 588.1, 390, 392, 52/533, 534, 553, 582.1, 586.1, 586.2, 52/589.1, 590.2, 590.3, 591.1–591.5, 52/592.4, 745.08, 745.19, 747.1, 747.11, 52/748.1, 748.11, 539; 403/381; 404/68, 404/70; 428/44, 47–50, 57, 58, 60, 61, 428/106, 192–194
See application file for complete search history.

(56) References Cited

U.S. PATENT DOCUMENTS 124,228 A 3/1872 Stuart
213,740 A 4/1879 Conner
274,354 A 3/1883 McCarthy et al.
316,176 A 4/1885 Ransom
634,581 A 10/1899 Miller
861,911 A 7/1907 Stewart
1,194,636 A 8/1916 Joy
1,723,306 A 8/1929 Sipe
1,743,492 A 1/1930 Sipe
1,809,393 A 6/1931 Rockwell
1,902,716 A 3/1933 Newton
2,026,511 A 12/1935 Storm
2,027,292 A 1/1936 Rockwell
2,110,728 A 3/1938 Hoggatt
2,142,305 A 1/1939 Davis
2,204,675 A 6/1940 Grunert
2,266,464 A 12/1941 Kraft
2,277,758 A 3/1942 Hawkins
2,430,200 A 11/1947 Wilson
2,596,280 A 5/1952 Nystrom
2,732,706 A 1/1956 Friedman
2,740,167 A 4/1956 Rowley
2,858,584 A 11/1958 Gaines
2,863,185 A 12/1958 Riedi
2,865,058 A 12/1958 Andersson
2,889,016 A 6/1959 Warren
3,023,681 A 3/1962 Worson
3,077,703 A 2/1963 Bergstrom
3,099,110 A 7/1963 Spaight
3,147,522 A 9/1964 Schumm
3,172,237 A 3/1965 Bradley
3,187,612 A 6/1965 Hervey
3,271,787 A 9/1966 Clary
3,276,797 A 10/1966 Humes, Jr.
3,308,588 A 3/1967 Von Wedel
3,325,585 A 6/1967 Brenneman
3,331,180 A 7/1967 Vissing et al.
3,378,958 A 4/1968 Parks et al.
3,396,640 A 8/1968 Fujihara
3,512,324 A 5/1970 Reed
3,517,927 A 6/1970 Kennel
3,526,071 A 9/1970 Watanabe
3,535,844 A 10/1970 Glaros
3,572,224 A 3/1971 Perry
3,579,941 A 5/1971 Tibbals
3,626,822 A 12/1971 Koster
3,640,191 A 2/1972 Hendrich
3,694,983 A 10/1972 Couquet
3,720,027 A 3/1973 Christensen
3,722,379 A 3/1973 Koester
3,731,445 A 5/1973 Hoffmann et al.
3,742,669 A 7/1973 Mansfeld
3,760,547 A 9/1973 Brenneman
3,760,548 A 9/1973 Sauer et al.
3,764,767 A 10/1973 Randolph
3,778,954 A 12/1973 Meserole
3,849,235 A 11/1974 Gwynne
3,919,820 A 11/1975 Green
3,950,915 A 4/1976 Cole
3,994,609 A 11/1976 Puccio
4,007,767 A 2/1977 Colledge
4,007,994 A 2/1977 Brown
4,030,852 A 6/1977 Hein
4,037,377 A 7/1977 Howell et al.
4,041,665 A 8/1977 de Munck
4,064,571 A 12/1977 Phipps
4,080,086 A 3/1978 Watson
4,082,129 A 4/1978 Morelock
4,100,710 A 7/1978 Kowallik
4,104,840 A 8/1978 Heintz et al.
4,107,892 A 8/1978 Bellem
4,113,399 A 9/1978 Hansen, Sr. et al.
4,154,041 A 5/1979 Namy
4,169,688 A 10/1979 Toshio
RE30,154 E 11/1979 Jarvis
4,196,554 A 4/1980 Anderson
4,227,430 A 10/1980 Janssen et al.
4,299,070 A 11/1981 Oltmanns
4,304,083 A 12/1981 Anderson
4,426,820 A 1/1984 Terbrack
4,447,172 A 5/1984 Galbreath
4,512,131 A 4/1985 Laramore
4,599,841 A 7/1986 Haid
4,622,784 A 11/1986 Black
4,648,165 A 3/1987 Whitehorne
4,819,932 A 4/1989 Trotter, Jr.
4,948,716 A 8/1990 Mihayashi et al.
4,998,395 A 3/1991 Bezner
5,007,222 A 4/1991 Raymond
5,026,112 A 6/1991 Rice
5,071,282 A 12/1991 Brown
5,135,597 A 8/1992 Barker
5,148,850 A 9/1992 Urbanick
5,173,012 A 12/1992 Ortwein et al.
5,182,892 A 2/1993 Chase
5,247,773 A 9/1993 Weir
5,272,850 A 12/1993 Mysliwiec et al.
5,274,979 A 1/1994 Tsai
5,281,055 A 1/1994 Neitzke et al.
5,295,341 A 3/1994 Kajiwara
5,344,700 A 9/1994 McGath et al.
5,348,778 A 9/1994 Knipp et al.
5,373,674 A 12/1994 Winter, IV
5,465,546 A 11/1995 Buse
5,485,702 A 1/1996 Sholton
5,502,939 A 4/1996 Zadok et al.
5,548,937 A 8/1996 Shimonohara
5,577,357 A 11/1996 Civelli
5,587,218 A 12/1996 Betz
5,598,682 A 2/1997 Haughian
5,616,389 A 4/1997 Blatz
5,618,602 A 4/1997 Nelson
5,634,309 A 6/1997 Polen
5,658,086 A 8/1997 Brokaw et al.
5,694,730 A 12/1997 Del Rincon et al.
5,755,068 A 5/1998 Ormiston
5,860,267 A 1/1999 Pervan
5,899,038 A 5/1999 Stroppiana
5,910,084 A 6/1999 Koike

(56) References Cited

U.S. PATENT DOCUMENTS 5,950,389 A 9/1999 Porter
5,970,675 A 10/1999 Schray
6,006,486 A 12/1999 Moriau
6,029,416 A 2/2000 Andersson
6,052,960 A 4/2000 Yonemura
6,065,262 A 5/2000 Motta
6,098,354 A 8/2000 Skandis
6,134,854 A 10/2000 Stanchfield
6,145,261 A 11/2000 Godfrey et al.
6,164,618 A 12/2000 Yonemura
6,173,548 B1 1/2001 Hamar et al.
6,182,410 B1 2/2001 Pervan
6,203,653 B1 3/2001 Seidner
6,210,512 B1 4/2001 Jones
6,254,301 B1 7/2001 Hatch
6,295,779 B1 10/2001 Canfield
6,314,701 B1 11/2001 Meyerson
6,324,809 B1 12/2001 Nelson
6,332,733 B1 12/2001 Hamberger
6,339,908 B1 1/2002 Chuang
6,345,481 B1 2/2002 Nelson
6,358,352 B1 3/2002 Schmidt
6,363,677 B1 4/2002 Chen et al.
6,385,936 B1 5/2002 Schneider
6,418,683 B1 7/2002 Martensson et al.
6,446,413 B1 9/2002 Gruber
6,449,918 B1 9/2002 Nelson
6,450,235 B1 9/2002 Lee
6,490,836 B1 12/2002 Moriau et al.
6,505,452 B1 1/2003 Hannig
6,546,691 B2 4/2003 Leopolder
6,553,724 B1 4/2003 Bigler
6,576,079 B1 6/2003 Kai
6,584,747 B2 7/2003 Kettler et al.
6,588,166 B2 7/2003 Martensson
6,591,568 B1 7/2003 Pålsson
6,601,359 B2 8/2003 Olofsson
6,617,009 B1 9/2003 Chen et al.
6,647,689 B2 11/2003 Pletzer et al.
6,647,690 B1 11/2003 Martensson
6,651,400 B1 11/2003 Murphy
6,670,019 B2 12/2003 Andersson
6,672,030 B2 1/2004 Schulte
6,681,820 B2 1/2004 Olofsson
6,682,254 B1 1/2004 Olofsson et al.
6,684,592 B2 2/2004 Martin
6,685,391 B1 2/2004 Gideon
6,729,091 B1 5/2004 Martensson
6,763,643 B1 7/2004 Martensson
6,766,622 B1 7/2004 Thiers
6,769,219 B2 8/2004 Schwitte et al.
6,769,835 B2 8/2004 Stridsman
6,802,166 B1 10/2004 Gerhard
6,804,926 B1 10/2004 Eisermann
6,808,777 B2 10/2004 Andersson et al.
6,854,235 B2 2/2005 Martensson
6,862,857 B2 3/2005 Tychsen
6,865,855 B2 3/2005 Knauseder
6,874,291 B1 4/2005 Weber
6,880,307 B2 4/2005 Schwitte et al.
6,948,716 B2 9/2005 Drouin
7,021,019 B2 4/2006 Knauseder
7,040,068 B2 5/2006 Moriau et al.
7,051,486 B2 5/2006 Pervan
7,108,031 B1 9/2006 Secrest
7,121,058 B2 10/2006 Pålsson
7,152,383 B1 12/2006 Wilkinson et al.
7,156,383 B1 1/2007 Jacobs
7,188,456 B2 3/2007 Knauseder
7,219,392 B2 5/2007 Mullet et al.
7,251,916 B2 8/2007 Konzelmann et al.
7,257,926 B1 8/2007 Kirby
7,337,588 B1 3/2008 Moebus
7,377,081 B2 5/2008 Ruhdorfer
7,380,383 B2 6/2008 Olofsson et al.
7,441,384 B2 10/2008 Miller et al.
7,451,578 B2 11/2008 Hannig
7,454,875 B2 11/2008 Pervan et al.
7,516,588 B2 4/2009 Pervan
7,517,427 B2 4/2009 Sjoberg et al.
7,520,092 B2 4/2009 Showers et al.
7,533,500 B2 5/2009 Morton et al.
7,556,849 B2 7/2009 Thompson et al.
7,568,322 B2 8/2009 Pervan
7,584,583 B2 9/2009 Bergelin et al.
7,591,116 B2 9/2009 Thiers et al.
7,614,197 B2 11/2009 Nelson
7,617,651 B2 11/2009 Grafenauer
7,621,092 B2 11/2009 Groeke et al.
7,621,094 B2 11/2009 Moriau et al.
7,634,884 B2 12/2009 Pervan
7,637,068 B2 12/2009 Pervan
7,644,553 B2 1/2010 Knauseder
7,654,055 B2 2/2010 Ricker
7,677,005 B2 3/2010 Pervan
7,716,889 B2 5/2010 Pervan
7,721,503 B2 5/2010 Pervan et al.
7,726,088 B2 6/2010 Muehlebach
7,748,176 B2 7/2010 Harding et al.
7,757,452 B2 7/2010 Pervan
7,802,411 B2 9/2010 Pervan
7,806,624 B2 10/2010 McLean et al.
7,827,749 B2 11/2010 Groeke et al.
7,841,144 B2 11/2010 Pervan et al.
7,841,145 B2 11/2010 Pervan et al.
7,841,150 B2 11/2010 Pervan
7,849,642 B2 12/2010 Forster et al.
7,856,789 B2 12/2010 Eisermann
7,861,482 B2 1/2011 Pervan et al.
7,866,110 B2 1/2011 Pervan
7,896,571 B1 3/2011 Hannig et al.
7,900,416 B1 3/2011 Yokubison et al.
7,908,815 B2 3/2011 Pervan et al.
7,908,816 B2 3/2011 Grafenauer
7,913,471 B2 3/2011 Pervan
7,930,862 B2 4/2011 Bergelin et al.
7,954,295 B2 6/2011 Pervan
7,964,133 B2 6/2011 Cappelle
7,980,039 B2 7/2011 Groeke
7,980,041 B2 7/2011 Pervan
8,001,741 B2 8/2011 Duernberger
8,006,458 B1 8/2011 Olofsson et al.
8,033,074 B2 10/2011 Pervan
8,042,311 B2 10/2011 Pervan
8,061,104 B2 11/2011 Pervan
8,079,196 B2 12/2011 Pervan
8,112,967 B2 2/2012 Pervan et al.
8,171,692 B2 5/2012 Pervan
8,181,416 B2 5/2012 Pervan et al.
8,191,334 B2 6/2012 Braun
8,220,217 B2 7/2012 Muehlebach
8,234,830 B2 8/2012 Pervan et al.
8,245,478 B2 8/2012 Bergelin
8,281,549 B2 10/2012 Du
8,302,367 B2 11/2012 Schulte
8,336,272 B2 12/2012 Prager et al.
8,341,914 B2 1/2013 Pervan et al.
8,341,915 B2 1/2013 Pervan et al.
8,353,140 B2 1/2013 Pervan et al.
8,359,794 B2 1/2013 Biro et al.
8,359,805 B2 1/2013 Pervan et al.
8,365,499 B2 2/2013 Nilsson et al.
8,375,673 B2 2/2013 Evjen
8,381,476 B2 2/2013 Hannig
8,381,477 B2 2/2013 Pervan et al.
8,387,327 B2 3/2013 Pervan
8,448,402 B2 5/2013 Pervan et al.
8,499,521 B2 8/2013 Pervan et al.
8,505,257 B2 8/2013 Boo et al.
8,511,031 B2 8/2013 Bergelin et al.
8,522,505 B2 9/2013 Beach
8,528,289 B2 9/2013 Pervan et al.
8,544,230 B2 10/2013 Pervan
8,544,232 B2 10/2013 Wybo

(56) References Cited

U.S. PATENT DOCUMENTS 8,544,233 B2 10/2013 Pålsson
8,544,234 B2 10/2013 Pervan et al.
8,572,922 B2 11/2013 Pervan
8,578,675 B2 11/2013 Palsson et al.
8,590,250 B2 11/2013 Oh
8,596,013 B2 12/2013 Boo
8,615,952 B2 12/2013 Engström
8,621,814 B2 1/2014 Cappelle
8,627,862 B2 1/2014 Pervan et al.
8,631,623 B2 1/2014 Engström
8,635,829 B2 1/2014 Schulte
8,640,418 B2 2/2014 Paetrow et al.
8,640,424 B2 2/2014 Pervan et al.
8,650,826 B2 2/2014 Pervan et al.
8,677,714 B2 3/2014 Pervan
8,689,512 B2 4/2014 Pervan
8,701,368 B2 4/2014 Vermeulen
8,707,650 B2 4/2014 Pervan
8,713,886 B2 5/2014 Boo et al.
8,733,065 B2 5/2014 Pervan
8,733,410 B2 5/2014 Pervan
8,763,341 B2 7/2014 Pervan
8,769,905 B2 7/2014 Pervan
8,776,473 B2 7/2014 Pervan et al.
8,806,832 B2 8/2014 Kell
8,833,026 B2 9/2014 Devos et al.
8,844,236 B2 9/2014 Pervan et al.
8,857,126 B2 10/2014 Pervan et al.
8,869,485 B2 10/2014 Pervan
8,887,468 B2 11/2014 Hakansson et al.
8,898,988 B2 12/2014 Pervan
8,925,274 B2 1/2015 Pervan et al.
8,938,929 B2 1/2015 Engström
8,959,866 B2 2/2015 Pervan
8,973,331 B2 3/2015 Boo
8,991,055 B2 3/2015 Cappelle
8,997,423 B2 4/2015 Mann
8,997,430 B1 4/2015 Vermeulen et al.
9,027,306 B2 5/2015 Pervan
9,051,738 B2 6/2015 Pervan et al.
9,068,360 B2 6/2015 Pervan
9,080,329 B2 7/2015 Döhring et al.
9,091,077 B2 7/2015 Boo
9,103,126 B2 8/2015 Kell
9,103,128 B2 8/2015 Pomberger
9,151,062 B2 10/2015 Cappelle et al.
9,181,697 B2 11/2015 Masanek, Jr. et al.
9,194,134 B2 11/2015 Nygren et al.
9,206,611 B2 12/2015 Vermeulen et al.
9,212,492 B2 12/2015 Pervan et al.
9,216,541 B2 12/2015 Boo et al.
9,238,917 B2 1/2016 Pervan et al.
9,284,737 B2 3/2016 Pervan et al.
9,290,948 B2 3/2016 Cappelle
9,309,679 B2 4/2016 Pervan et al.
9,316,002 B2 4/2016 Boo
9,340,974 B2 5/2016 Pervan et al.
9,347,227 B2 5/2016 Ramachandra et al.
9,347,469 B2 5/2016 Pervan
9,359,774 B2 6/2016 Pervan
9,366,034 B2 6/2016 Meirlaen et al.
9,366,036 B2 6/2016 Pervan
9,371,654 B2 6/2016 Capelle
9,376,821 B2 6/2016 Pervan et al.
9,382,716 B2 7/2016 Pervan et al.
9,388,584 B2 7/2016 Pervan et al.
9,428,919 B2 8/2016 Pervan et al.
9,453,347 B2 9/2016 Pervan et al.
9,458,634 B2 10/2016 Derelov
9,482,012 B2 11/2016 Nygren et al.
9,540,825 B2 1/2017 Ramachandra
9,540,826 B2 1/2017 Pervan et al.
9,663,940 B2 5/2017 Boo
9,725,912 B2 8/2017 Pervan
9,771,723 B2 9/2017 Pervan
9,777,487 B2 10/2017 Pervan et al.
9,803,374 B2 10/2017 Pervan
9,803,375 B2 10/2017 Pervan
9,822,533 B2 11/2017 Huang
9,856,656 B2 1/2018 Pervan
9,874,027 B2 1/2018 Pervan
9,945,130 B2 4/2018 Nygren et al.
9,951,526 B2 4/2018 Boo et al.
10,000,935 B2 6/2018 Kell
10,006,210 B2 6/2018 Pervan et al.
10,017,948 B2 7/2018 Boo
10,113,319 B2 10/2018 Pervan
10,125,488 B2 11/2018 Boo
10,138,636 B2 11/2018 Pervan
10,161,139 B2 12/2018 Pervan
10,180,005 B2 1/2019 Pervan et al.
10,214,915 B2 2/2019 Pervan et al.
10,214,917 B2 2/2019 Pervan et al.
10,240,348 B2 3/2019 Pervan et al.
10,240,349 B2 3/2019 Pervan et al.
10,246,883 B2 4/2019 Derelöv
10,352,049 B2 7/2019 Boo
10,358,830 B2 7/2019 Pervan
10,378,217 B2 8/2019 Pervan
10,458,125 B2 10/2019 Pervan
10,480,196 B2 11/2019 Boo
10,519,676 B2 12/2019 Pervan
10,526,792 B2 1/2020 Pervan et al.
10,538,922 B2 1/2020 Pervan
10,570,625 B2 2/2020 Pervan
10,640,989 B2 5/2020 Pervan
10,655,339 B2 5/2020 Pervan
10,669,723 B2 6/2020 Pervan et al.
10,724,251 B2 7/2020 Kell
10,731,358 B2 8/2020 Pervan
10,794,065 B2 10/2020 Boo et al.
10,828,798 B2 11/2020 Fransson
2001/0024707 A1 9/2001 Andersson et al.
2001/0034991 A1 11/2001 Martensson
2001/0045150 A1 11/2001 Owens
2002/0014047 A1 2/2002 Thiers
2002/0031646 A1 3/2002 Chen et al.
2002/0069611 A1 6/2002 Leopolder
2002/0092263 A1 7/2002 Schulte
2002/0095894 A1 7/2002 Pervan
2002/0108343 A1 8/2002 Knauseder
2002/0170258 A1 11/2002 Schwitte et al.
2002/0170259 A1 11/2002 Ferris
2002/0178674 A1 12/2002 Pervan
2002/0178680 A1 12/2002 Martensson
2002/0189190 A1 12/2002 Charmat et al.
2002/0189747 A1 12/2002 Steinwender
2002/0194807 A1 12/2002 Nelson et al.
2003/0009971 A1 1/2003 Palmberg
2003/0024199 A1 2/2003 Pervan et al.
2003/0037504 A1 2/2003 Schwitte et al.
2003/0066588 A1 4/2003 Pålsson
2003/0084636 A1 5/2003 Pervan
2003/0094230 A1 5/2003 Sjoberg
2003/0101674 A1 6/2003 Pervan
2003/0101681 A1 6/2003 Tychsen
2003/0145549 A1 8/2003 Palsson et al.
2003/0180091 A1 9/2003 Stridsman
2003/0188504 A1 10/2003 Ralf
2003/0196405 A1 10/2003 Pervan
2004/0016196 A1 1/2004 Pervan
2004/0031225 A1 2/2004 Fowler
2004/0031227 A1 2/2004 Knauseder
2004/0049999 A1 3/2004 Krieger
2004/0060255 A1 4/2004 Knauseder
2004/0068954 A1 4/2004 Martensson
2004/0123548 A1 7/2004 Gimpel et al.
2004/0128934 A1 7/2004 Hecht
2004/0137180 A1 7/2004 Sjoberg et al.
2004/0139676 A1 7/2004 Knauseder
2004/0139678 A1 7/2004 Pervan
2004/0159066 A1 8/2004 Thiers et al.
2004/0168392 A1 9/2004 Konzelmann et al.
2004/0177584 A1 9/2004 Pervan

(56) References Cited

U.S. PATENT DOCUMENTS

2004/0182033 A1 9/2004 Wernersson
2004/0182036 A1 9/2004 Sjoberg et al.
2004/0200175 A1 10/2004 Weber
2004/0211143 A1 10/2004 Hanning
2004/0238001 A1 12/2004 Risden
2004/0244325 A1 12/2004 Nelson
2004/0250492 A1 12/2004 Becker
2004/0261348 A1 12/2004 Vulin
2005/0003132 A1 1/2005 Blix et al.
2005/0028474 A1 2/2005 Kim
2005/0050827 A1 3/2005 Schitter
2005/0160694 A1 7/2005 Pervan
2005/0166514 A1 8/2005 Pervan
2005/0183370 A1 8/2005 Cripps
2005/0205161 A1 9/2005 Lewark
2005/0210810 A1 9/2005 Pervan
2005/0235593 A1 10/2005 Hecht
2005/0252130 A1 11/2005 Martensson
2005/0252167 A1 11/2005 Van Horne, Jr.
2005/0268570 A2 12/2005 Pervan
2006/0053724 A1 3/2006 Braun et al.
2006/0070333 A1 4/2006 Pervan
2006/0101769 A1 5/2006 Pervan
2006/0156670 A1 7/2006 Knauseder
2006/0174577 A1 8/2006 O'Neil
2006/0179754 A1 8/2006 Yang
2006/0185287 A1 8/2006 Glazer et al.
2006/0236642 A1 10/2006 Pervan
2006/0260254 A1 11/2006 Pervan et al.
2006/0272262 A1 12/2006 Pomberger
2007/0003366 A1 1/2007 Wedberg
2007/0006543 A1 1/2007 Engström
2007/0011981 A1 1/2007 Eisermann
2007/0022689 A1 2/2007 Thrush et al.
2007/0028547 A1 2/2007 Grafenauer
2007/0065293 A1 3/2007 Hannig
2007/0094969 A1 5/2007 McIntosh et al.
2007/0094985 A1 5/2007 Grafenauer
2007/0108679 A1 5/2007 Grothaus
2007/0113509 A1 5/2007 Zhang
2007/0151189 A1 7/2007 Yang et al.
2007/0175156 A1 8/2007 Pervan et al.
2007/0193178 A1 8/2007 Groeke et al.
2007/0209736 A1 9/2007 Deringor et al.
2007/0214741 A1 9/2007 Llorens Miravet
2008/0000182 A1 1/2008 Pervan
2008/0000185 A1 1/2008 Duernberger
2008/0000186 A1 1/2008 Pervan et al.
2008/0000187 A1 1/2008 Pervan et al.
2008/0005998 A1 1/2008 Pervan
2008/0010931 A1 1/2008 Pervan et al.
2008/0010937 A1 1/2008 Pervan et al.
2008/0028707 A1 2/2008 Pervan
2008/0034708 A1 2/2008 Pervan
2008/0041008 A1 2/2008 Pervan
2008/0053029 A1 3/2008 Ricker
2008/0066415 A1 3/2008 Pervan
2008/0104921 A1 5/2008 Pervan et al.
2008/0110125 A1 5/2008 Pervan
2008/0134607 A1 6/2008 Pervan
2008/0134613 A1 6/2008 Pervan
2008/0134614 A1 6/2008 Pervan
2008/0155930 A1 7/2008 Pervan et al.
2008/0184646 A1 8/2008 Alford
2008/0199676 A1 8/2008 Bathelier et al.
2008/0216434 A1 9/2008 Pervan
2008/0216920 A1 9/2008 Pervan
2008/0236088 A1 10/2008 Hannig et al.
2008/0295432 A1 12/2008 Pervan et al.
2008/0295438 A1 12/2008 Knauseder
2008/0302044 A1 12/2008 Johansson
2009/0019806 A1 1/2009 Muehlebach
2009/0049787 A1 2/2009 Hannig
2009/0064624 A1 3/2009 Sokol
2009/0100782 A1 4/2009 Groeke et al.
2009/0133353 A1 5/2009 Pervan et al.
2009/0151290 A1 6/2009 Liu
2009/0173032 A1 7/2009 Prager et al.
2009/0193741 A1 8/2009 Cappelle
2009/0193748 A1 8/2009 Boo et al.
2009/0193753 A1 8/2009 Schitter
2009/0217615 A1 9/2009 Engstrom
2009/0241460 A1 10/2009 Beaulieu
2009/0249733 A1 10/2009 Moebus
2009/0308014 A1 12/2009 Muehlebach
2010/0018149 A1 1/2010 Thiers
2010/0043333 A1 2/2010 Hannig et al.
2010/0083603 A1 4/2010 Goodwin
2010/0170189 A1 7/2010 Schulte
2010/0173122 A1 7/2010 Susnjara
2010/0218450 A1 9/2010 Braun
2010/0275541 A1 11/2010 Prinz
2010/0281803 A1 11/2010 Cappelle
2010/0293879 A1 11/2010 Pervan et al.
2010/0300029 A1 12/2010 Braun et al.
2010/0300031 A1 12/2010 Pervan et al.
2010/0313510 A1 12/2010 Tang
2010/0319290 A1 12/2010 Pervan
2010/0319291 A1 12/2010 Pervan et al.
2011/0016815 A1 1/2011 Yang
2011/0030303 A1 2/2011 Pervan et al.
2011/0041996 A1 2/2011 Pervan
2011/0047922 A1 3/2011 Fleming, III
2011/0088344 A1 4/2011 Pervan et al.
2011/0088345 A1 4/2011 Pervan
2011/0088346 A1 4/2011 Hannig
2011/0094178 A1 4/2011 Braun
2011/0131916 A1 6/2011 Chen
2011/0138722 A1 6/2011 Hannig
2011/0154763 A1 6/2011 Bergelin et al.
2011/0162312 A1 7/2011 Schulte
2011/0167750 A1 7/2011 Pervan
2011/0167751 A1 7/2011 Engström
2011/0173914 A1 7/2011 Engström
2011/0197535 A1 8/2011 Baker et al.
2011/0225921 A1 9/2011 Schulte
2011/0225922 A1 9/2011 Pervan et al.
2011/0247285 A1 10/2011 Wybo et al.
2011/0252733 A1 10/2011 Pervan
2011/0271631 A1 11/2011 Engstrom
2011/0271632 A1 11/2011 Cappelle et al.
2011/0283650 A1 11/2011 Pervan et al.
2012/0017533 A1 1/2012 Pervan et al.
2012/0031029 A1 2/2012 Pervan et al.
2012/0036804 A1 2/2012 Pervan
2012/0042598 A1 2/2012 Vermeulen et al.
2012/0055112 A1 3/2012 Engström
2012/0124932 A1 5/2012 Schulte et al.
2012/0151865 A1 6/2012 Pervan et al.
2012/0174515 A1 7/2012 Pervan
2012/0174519 A1 7/2012 Schulte
2012/0174520 A1 7/2012 Pervan
2012/0174521 A1 7/2012 Schulte et al.
2012/0192521 A1 8/2012 Schulte
2012/0222378 A1 9/2012 Cappelle et al.
2012/0240502 A1 9/2012 Wilson et al.
2012/0279161 A1 11/2012 Håkansson et al.
2012/0304590 A1 12/2012 Engström
2012/0324816 A1 12/2012 Huang
2013/0008117 A1 1/2013 Pervan
2013/0008118 A1 1/2013 Baert et al.
2013/0014463 A1 1/2013 Pervan
2013/0019555 A1 1/2013 Pervan
2013/0025231 A1 1/2013 Vermeulen
2013/0025964 A1 1/2013 Ramachandra et al.
2013/0042562 A1 2/2013 Pervan
2013/0042563 A1 2/2013 Pervan
2013/0042564 A1 2/2013 Pervan et al.
2013/0042565 A1 2/2013 Pervan
2013/0047536 A1 2/2013 Pervan
2013/0081349 A1 4/2013 Pervan et al.
2013/0111837 A1 5/2013 Devos et al.
2013/0111845 A1 5/2013 Pervan
2013/0145708 A1 6/2013 Pervan

(56) References Cited

U.S. PATENT DOCUMENTS

| | | | |
|---|---|---|---|
| 2013/0152500 | A1 | 6/2013 | Engström |
| 2013/0160391 | A1 | 6/2013 | Pervan et al. |
| 2013/0167467 | A1 | 7/2013 | Vermeulen et al. |
| 2013/0219806 | A1 | 8/2013 | Carrubba |
| 2013/0232905 | A2 | 9/2013 | Pervan |
| 2013/0239508 | A1 | 9/2013 | Pervan et al. |
| 2013/0263454 | A1 | 10/2013 | Boo et al. |
| 2013/0263547 | A1 | 10/2013 | Boo |
| 2013/0283719 | A1 | 10/2013 | Döhring et al. |
| 2013/0305650 | A1 | 11/2013 | Liu |
| 2013/0309441 | A1 | 11/2013 | Hannig |
| 2013/0318906 | A1 | 12/2013 | Pervan et al. |
| 2014/0007539 | A1 | 1/2014 | Pervan et al. |
| 2014/0020324 | A1 | 1/2014 | Pervan |
| 2014/0026513 | A1 | 1/2014 | Bishop |
| 2014/0033633 | A1 | 2/2014 | Kell |
| 2014/0033634 | A1 | 2/2014 | Pervan |
| 2014/0053497 | A1 | 2/2014 | Pervan et al. |
| 2014/0059966 | A1 | 3/2014 | Boo |
| 2014/0069043 | A1 | 3/2014 | Pervan |
| 2014/0090335 | A1 | 4/2014 | Pervan et al. |
| 2014/0109501 | A1 | 4/2014 | Pervan |
| 2014/0109506 | A1 | 4/2014 | Pervan et al. |
| 2014/0123586 | A1 | 5/2014 | Pervan et al. |
| 2014/0130437 | A1 | 5/2014 | Cappelle |
| 2014/0140766 | A1 | 5/2014 | Riccobene et al. |
| 2014/0144096 | A1 | 5/2014 | Vermeulen et al. |
| 2014/0150369 | A1 | 6/2014 | Hannig |
| 2014/0190112 | A1 | 7/2014 | Pervan |
| 2014/0208677 | A1 | 7/2014 | Pervan et al. |
| 2014/0223852 | A1 | 8/2014 | Pervan |
| 2014/0237931 | A1 | 8/2014 | Pervan |
| 2014/0250813 | A1 | 9/2014 | Nygren et al. |
| 2014/0260060 | A1 | 9/2014 | Pervan et al. |
| 2014/0283466 | A1 | 9/2014 | Boo |
| 2014/0305065 | A1 | 10/2014 | Pervan |
| 2014/0338177 | A1 | 11/2014 | Vermeulen et al. |
| 2014/0366476 | A1 | 12/2014 | Pervan |
| 2014/0366477 | A1 | 12/2014 | Kell |
| 2014/0373478 | A2 | 12/2014 | Pervan et al. |
| 2014/0373480 | A1 | 12/2014 | Pervan et al. |
| 2015/0000221 | A1 | 1/2015 | Boo |
| 2015/0013260 | A1 | 1/2015 | Pervan |
| 2015/0047284 | A1 | 2/2015 | Cappelle |
| 2015/0059281 | A1 | 3/2015 | Pervan |
| 2015/0089896 | A2 | 4/2015 | Pervan et al. |
| 2015/0113908 | A1 | 4/2015 | Ramachandra et al. |
| 2015/0121796 | A1 | 5/2015 | Pervan |
| 2015/0152644 | A1 | 6/2015 | Boo |
| 2015/0167318 | A1 | 6/2015 | Pervan |
| 2015/0176619 | A1 | 6/2015 | Baker |
| 2015/0211239 | A1 | 7/2015 | Pervan |
| 2015/0233125 | A1 | 8/2015 | Pervan et al. |
| 2015/0267419 | A1 | 9/2015 | Pervan |
| 2015/0300029 | A1 | 10/2015 | Pervan |
| 2015/0330088 | A1 | 11/2015 | Derelov |
| 2015/0337537 | A1 | 11/2015 | Boo |
| 2015/0368910 | A1 | 12/2015 | Kell |
| 2016/0032596 | A1 | 2/2016 | Nygren et al. |
| 2016/0060879 | A1 | 3/2016 | Pervan |
| 2016/0069088 | A1 | 3/2016 | Boo et al. |
| 2016/0076260 | A1 | 3/2016 | Pervan et al. |
| 2016/0090744 | A1 | 3/2016 | Pervan et al. |
| 2016/0153200 | A1 | 6/2016 | Pervan |
| 2016/0168866 | A1 | 6/2016 | Pervan et al. |
| 2016/0186426 | A1 | 6/2016 | Boo |
| 2016/0194884 | A1 | 7/2016 | Pervan et al. |
| 2016/0201336 | A1 | 7/2016 | Pervan |
| 2016/0251859 | A1 | 9/2016 | Pervan et al. |
| 2016/0251860 | A1 | 9/2016 | Pervan |
| 2016/0281368 | A1 | 9/2016 | Pervan et al. |
| 2016/0281370 | A1 | 9/2016 | Pervan et al. |
| 2016/0326751 | A1 | 11/2016 | Pervan |
| 2016/0340913 | A1 | 11/2016 | Derelöv |
| 2017/0037641 | A1 | 2/2017 | Nygren et al. |
| 2017/0081860 | A1 | 3/2017 | Boo |
| 2017/0254096 | A1 | 9/2017 | Pervan |
| 2017/0321433 | A1 | 11/2017 | Pervan et al. |
| 2017/0362834 | A1 | 12/2017 | Pervan et al. |
| 2018/0001509 | A1 | 1/2018 | Myllykangas et al. |
| 2018/0001510 | A1 | 1/2018 | Fransson |
| 2018/0001573 | A1 | 1/2018 | Blomgren et al. |
| 2018/0002933 | A1 | 1/2018 | Pervan |
| 2018/0016783 | A1 | 1/2018 | Boo |
| 2018/0030737 | A1 | 2/2018 | Pervan |
| 2018/0030738 | A1 | 2/2018 | Pervan |
| 2018/0119431 | A1 | 5/2018 | Pervan et al. |
| 2018/0178406 | A1 | 6/2018 | Fransson et al. |
| 2018/0313094 | A1 | 11/2018 | Pervan |
| 2019/0024387 | A1 | 1/2019 | Pervan et al. |
| 2019/0048592 | A1 | 2/2019 | Boo |
| 2019/0048596 | A1 | 2/2019 | Pervan |
| 2019/0063076 | A1 | 2/2019 | Boo et al. |
| 2019/0093370 | A1 | 3/2019 | Pervan et al. |
| 2019/0093371 | A1 | 3/2019 | Pervan |
| 2019/0127989 | A1 | 5/2019 | Kell |
| 2019/0127990 | A1 | 5/2019 | Pervan et al. |
| 2019/0169859 | A1 | 6/2019 | Pervan et al. |
| 2019/0232473 | A1 | 8/2019 | Fransson et al. |
| 2019/0271165 | A1 | 9/2019 | Boo |
| 2019/0376298 | A1 | 12/2019 | Pervan et al. |
| 2019/0394314 | A1 | 12/2019 | Pervan et al. |
| 2020/0087927 | A1 | 3/2020 | Pervan |
| 2020/0102756 | A1 | 4/2020 | Pervan |
| 2020/0109569 | A1 | 4/2020 | Pervan |
| 2020/0149289 | A1 | 5/2020 | Pervan |
| 2020/0173175 | A1 | 6/2020 | Pervan |
| 2020/0224430 | A1 | 7/2020 | Ylikangas et al. |
| 2020/0263437 | A1 | 8/2020 | Pervan |
| 2020/0318667 | A1 | 10/2020 | Derelöv |
| 2020/0354969 | A1 | 11/2020 | Pervan et al. |

FOREIGN PATENT DOCUMENTS

| | | | |
|---|---|---|---|
| DE | 138 992 | C | 7/1901 |
| DE | 142 293 | C | 7/1902 |
| DE | 2 159 042 | | 6/1973 |
| DE | 25 05 489 | A1 | 6/1973 |
| DE | 33 43 601 | A1 | 6/1985 |
| DE | 33 43 601 | C2 | 6/1985 |
| DE | 39 32 980 | A1 | 11/1991 |
| DE | 42 15 273 | A1 | 11/1993 |
| DE | 42 42 530 | A1 | 6/1994 |
| DE | 196 01 322 | A | 5/1997 |
| DE | 299 22 649 | U1 | 3/2000 |
| DE | 200 02 744 | U1 | 8/2000 |
| DE | 199 40 837 | A1 | 11/2000 |
| DE | 199 58 225 | A1 | 6/2001 |
| DE | 202 05 774 | U1 | 8/2002 |
| DE | 10 2004 001 363 | A1 | 8/2005 |
| DE | 10 2005 002 297 | A1 | 8/2005 |
| DE | 10 2006 024 184 | A1 | 11/2007 |
| DE | 10 2007 018 309 | A1 | 8/2008 |
| DE | 10 2007 016 533 | A1 | 10/2008 |
| DE | 10 2007 032 885 | A1 | 1/2009 |
| DE | 10 2007 035 648 | A1 | 1/2009 |
| DE | 10 2007 049 792 | A1 | 2/2009 |
| DE | 10 2009 041 297 | A1 | 3/2011 |
| EP | 0 013 852 | A1 | 8/1980 |
| EP | 0 871 156 | A2 | 10/1998 |
| EP | 1 120 515 | A1 | 8/2001 |
| EP | 1 146 182 | A2 | 10/2001 |
| EP | 1 251 219 | A | 10/2002 |
| EP | 1 279 778 | A2 | 1/2003 |
| EP | 1 350 904 | A2 | 10/2003 |
| EP | 1 350 904 | A3 | 10/2003 |
| EP | 1 396 593 | A2 | 3/2004 |
| EP | 1 420 125 | A2 | 5/2004 |
| EP | 1 437 457 | A2 | 7/2004 |
| EP | 1 437 457 | A3 | 7/2004 |
| EP | 1 640 530 | A2 | 3/2006 |
| EP | 1 650 375 | A1 | 4/2006 |
| EP | 1 650 375 | A8 | 9/2006 |
| EP | 1 980 683 | A2 | 10/2008 |

(56) References Cited

FOREIGN PATENT DOCUMENTS

| | | | |
|---|---|---|---|
| EP | 2 000 610 | A1 | 12/2008 |
| EP | 2 236 694 | A1 | 10/2010 |
| EP | 2 270 291 | A1 | 1/2011 |
| EP | 2 278 091 | A2 | 1/2011 |
| EP | 2 270 291 | B1 | 5/2011 |
| EP | 2 333 195 | A1 | 6/2011 |
| EP | 2 388 394 | A2 | 11/2011 |
| FR | 1135595 | | 6/1957 |
| FR | 2 256 807 | | 8/1975 |
| FR | 2 810 060 | A1 | 12/2001 |
| GB | 240629 | | 10/1925 |
| GB | 376352 | | 7/1932 |
| GB | 1171337 | | 11/1969 |
| GB | 2 051 916 | A | 1/1981 |
| JP | H03-110258 | A | 5/1991 |
| JP | H05-018028 | A | 1/1993 |
| JP | H06-146553 | A | 5/1994 |
| JP | H06-288017 | A | 10/1994 |
| JP | H06-306961 | A | 11/1994 |
| JP | H06-322848 | A | 11/1994 |
| JP | H07-300979 | A | 11/1995 |
| JP | 2900115 | B2 | 6/1999 |
| JP | 2002-047782 | A | 2/2002 |
| SE | 526 688 | C2 | 5/2005 |
| WO | WO 94/26999 | A1 | 11/1994 |
| WO | WO 96/27721 | A1 | 9/1996 |
| WO | WO 97/47834 | A1 | 12/1997 |
| WO | WO 98/22677 | A1 | 5/1998 |
| WO | WO 99/66151 | A1 | 12/1999 |
| WO | WO 99/66152 | A1 | 12/1999 |
| WO | WO 00/43281 | A2 | 7/2000 |
| WO | WO 00/47841 | A1 | 8/2000 |
| WO | WO 00/55067 | A1 | 9/2000 |
| WO | WO 01/02670 | A1 | 1/2001 |
| WO | WO 01/02672 | A1 | 1/2001 |
| WO | WO 01/07729 | A1 | 2/2001 |
| WO | WO 2011/012105 | A1 | 2/2001 |
| WO | WO 01/38657 | A1 | 5/2001 |
| WO | WO 01/44669 | A2 | 6/2001 |
| WO | WO 01/44669 | A3 | 6/2001 |
| WO | WO 01/48332 | A1 | 7/2001 |
| WO | WO 01/51732 | A1 | 7/2001 |
| WO | WO 01/51733 | A1 | 7/2001 |
| WO | WO 01/66877 | A1 | 9/2001 |
| WO | WO 01/75247 | A1 | 10/2001 |
| WO | WO 01/77461 | A1 | 10/2001 |
| WO | WO 02/055809 | A1 | 7/2002 |
| WO | WO 02/055810 | A1 | 7/2002 |
| WO | WO 02/081843 | A1 | 10/2002 |
| WO | WO 02/103135 | A1 | 12/2002 |
| WO | WO 03/012224 | A1 | 2/2003 |
| WO | WO 03/016654 | A1 | 2/2003 |
| WO | WO 03/025307 | A1 | 3/2003 |
| WO | WO 03/038210 | A1 | 5/2003 |
| WO | WO 03/044303 | A1 | 5/2003 |
| WO | WO 03/074814 | A1 | 9/2003 |
| WO | WO 03/083234 | A1 | 10/2003 |
| WO | WO 03/087497 | A1 | 10/2003 |
| WO | WO 03/089736 | A1 | 10/2003 |
| WO | WO 2004/003314 | A1 | 1/2004 |
| WO | WO 2004/020764 | A1 | 3/2004 |
| WO | WO 2004/048716 | A1 | 6/2004 |
| WO | WO 2004/050780 | A2 | 6/2004 |
| WO | WO 2004/079128 | A1 | 9/2004 |
| WO | WO 2004/079130 | A1 | 9/2004 |
| WO | WO 2004/085765 | A1 | 10/2004 |
| WO | WO 2005/003488 | A1 | 1/2005 |
| WO | WO 2005/003489 | A1 | 1/2005 |
| WO | WO 2005/054599 | A1 | 6/2005 |
| WO | WO 2006/043893 | A1 | 4/2006 |
| WO | WO 2006/050928 | A1 | 5/2006 |
| WO | WO 2006/104436 | A1 | 10/2006 |
| WO | WO 2006/123988 | A1 | 11/2006 |
| WO | WO 2006/125646 | A1 | 11/2006 |
| WO | WO 2007/015669 | A2 | 2/2007 |
| WO | WO 2007/015669 | A3 | 2/2007 |
| WO | WO 2007/142589 | A1 | 12/2007 |
| WO | WO 2008/004960 | A2 | 1/2008 |
| WO | WO 2008/004960 | A3 | 1/2008 |
| WO | WO 2008/004960 | A8 | 1/2008 |
| WO | WO 2008/017281 | A1 | 2/2008 |
| WO | WO 2008/060232 | A1 | 5/2008 |
| WO | WO 2009/066153 | A2 | 5/2009 |
| WO | WO 2009/116926 | A1 | 9/2009 |
| WO | WO 2010/070472 | A2 | 6/2010 |
| WO | WO 2010/070472 | A3 | 6/2010 |
| WO | WO 2010/070605 | A2 | 6/2010 |
| WO | WO 2010/087752 | A1 | 8/2010 |
| WO | WO 2011/001326 | A2 | 1/2011 |
| WO | WO 2011/012104 | A2 | 2/2011 |
| WO | WO 2011/012104 | A3 | 2/2011 |
| WO | WO 2011/032540 | A2 | 3/2011 |
| WO | WO 2011/038709 | A1 | 4/2011 |
| WO | WO 2011/108812 | A2 | 9/2011 |
| WO | WO 2011/151758 | A2 | 12/2011 |
| WO | WO 2011/151758 | A3 | 12/2011 |
| WO | WO 2012/059093 | A2 | 5/2012 |
| WO | WO 2013/012386 | A1 | 1/2013 |

OTHER PUBLICATIONS

U.S. Appl. No. 16/781,301, Darko Pervan, filed Feb. 4, 2020.
U.S. Appl. No. 16/713,373, Ylikangas.
U.S. Appl. No. 16/781,301, Pervan.
Ylikangas, Roger, et al., U.S. Appl. No. 16/713,373 entitled "Unlocking System for Panels," filed in the U.S. Patent and Trademark Office on Dec. 13, 2019.
Pervan, Darko, U.S. Appl. No. 16/781,301 entitled "Mechanical Locking of Floor Panels," filed in the U.S. Patent and Trademark Office on Feb. 4, 2020.
U.S. Appl. No. 16/692,104, Pervan.
Extended European Search Report dated Dec. 6, 2017 in EP 17198982.5, European Patent Office, Munich, DE, 6 pages.
Pervan, Darko, U.S. Appl. No. 16/692,104 entitled "Mechanical Locking System for Floor Panels," filed in the U.S. Patent and Trademark Office on Nov. 22, 2019.
U.S. Appl. No. 14/503,780, Darko Pervan, filed Oct. 1, 2014.
U.S. Appl. No. 15/172,926, Darko Pervan and Agne Pålsson, filed Jun. 3, 2016.
U.S. Appl. No. 15/603,913, Darko Pervan, filed May 24, 2017.
U.S. Appl. No. 15/896,571, Darko Pervan, Niclas Håkansson and Per Nygren, filed Feb. 14, 2018.
U.S. Appl. No. 16/143,610, Darko Pervan, filed Sep. 27, 2018.
U.S. Appl. No. 16/163,088, Darko Pervan, filed Oct. 17, 2018.
U.S. Appl. No. 16/269,806, Darko Pervan and Tony Pervan, filed Feb. 7, 2019.
U.S. Appl. No. 16/419,660, Christian Boo, filed May 22, 2019.
U.S. Appl. No. 16/439,827, Darko Pervan, filed Jun. 13, 2019.
U.S. Appl. No. 16/581,990, Darko Pervan, filed Sep. 25, 2019.
U.S. Appl. No. 16/439,827, Pervan.
U.S. Appl. No. 16/581,990, Pervan.
International Search Report dated Oct. 30, 2012 in PCT/SE2012/050872, Swedish Patent Office, Stockholm, Sweden, 5 pages.
Extended European Search Report dated Apr. 19, 2016 in EP 12 82 4331.8, European Patent Office, Munich, DE, 7 pages.
Välinge Innovation AB, Technical Disclosure entitled "Mechanical locking for floor panels with a flexible bristle tongue," IP.com No. IPCOM000145262D, Jan. 12, 2007, IP.com PriorArtDatabase, 57 pages (VA033).
Engstrand, Ola (Contact)/Välinge Innovation AB, Technical Disclosure entitled "VA-038 Mechanical Locking of Floor Panels With Vertical Folding," IP com No. IPCOM000179246D, Feb. 10, 2009, IP.com Prior Art Database, 59 pages.
Engstrand, Ola (Contact)/Välinge Innovation AB, Technical Disclosure entitled "VA043 5G Linear Slide Tongue," IP com No. IPCOM000179015D, Feb. 4, 2009, IP.com Prior Art Database, 126 pages.

(56) References Cited

OTHER PUBLICATIONS

Engstrand, Ola (Owner)/Väalinge Innovation AB, Technical Disclosure entitled "VA043b PCT Mechanical Locking of Floor Panels," IP com No. IPCOM000189420D, Nov. 9, 2009, IP.com Prior Art Database, 62 pages.
Engstrand, Ola (Contact)/Välinge Innovation AB, Technical Disclosure entitled "VA055 Mechanical locking system for floor panels," IP com No. IPCOM000206454D, Apr. 27, 2011, IP.com Prior Art Database, 25 pages.
Engstrand, Ola (Contact)/Välinge Innovation AB, Technical Disclosure entitled "VA058 Rocker Tongue," IP com No. IPCOM000203832D, Feb. 4, 2011, IP.com Prior Art Database, 22 pages.
Pervan, Darko (Author)/Välinge Flooring Technology, Technical Disclosure entitled "VA066b Glued Tongue," IP com No. IPCOM000210865D, Sep. 13, 2011, IP.com Prior Art Database, 19 pages.
Pervan, Darko (Inventor)/Välinge Flooring Technology AB, Technical Disclosure entitled "VA067 Fold Slide Loc," IP com No. IPCOM000208542D, Jul. 12, 2011, IP.com Prior Art Database, 37 pages.
Pervan, Darko (Author)/Välinge Flooring Technology, Technical Disclosure entitled "VA068 Press Lock VFT," IP com No. IPCOM000208854D, Jul. 20, 2011, IP.com Prior Art Database, 25 pages.
Pervan, Darko (Author), Technical Disclosure entitled "VA069 Combi Tongue," IP com No. IPCOM000210866D, Sep. 13, 2011, IP.com Prior Art Database, 41 pages.
Pervan, Darko (Author), Technical Disclosure entitled "VA070 Strip Part," IP com No. IPCOM000210867D, Sep. 13, 2011, IP.com Prior Art Database, 43 pages.
Pervan, Darko (Author), Technical Disclosure entitled "VA071 Pull Lock," IP com No. IPCOM000210868D, Sep. 13, 2011, IP.com Prior Art Database, 22 pages.
Pervan, Darko (Author), Technical Disclosure entitled "VA073a Zip Loc," IP com No. IPCOM000210869D, Sep. 13, 2011, IP.com Prior Art Database, 36 pages.
LifeTips, "Laminate Flooring Tips," available at (http://flooring.lifetips.com/cat/61734/laminate-flooring-tips/index.html), 2000, 12 pages.
Pervan, Darko, U.S. Appl. No. 16/439,827 entitled "Mechanical Locking of Floor Panels With Vertical Folding," filed in the U.S. Patent and Trademark Office on Jun. 13, 2019.
Pervan, Darko, U.S. Appl. No. 16/581,990 entitled "Mechanical Locking System for Floor Panels," filed in the U.S. Patent and Trademark Office on Sep. 25, 2019.
U.S. Appl. No. 16/861,666, Darko Pervan, filed Apr. 29, 2020.
U.S. Appl. No. 16/861,686, Darko Pervan and Agne Pålsson, filed Apr. 29, 2020.
U.S. Appl. No. 16/908,902, Darko Pervan, filed Jun. 23, 2020.
U.S. Appl. No. 16/861,666, Pervan.
U.S. Appl. No. 16/861,686, Pervan et al.
U.S. Appl. No. 16/908,902, Pervan.
Pervan, Darko, U.S. Appl. No. 16/861,666 entitled "Mechanical Locking System for Panels and Method of Installing Same," filed in the U.S. Patent and Trademark Office on Apr. 29, 2020.
Pervan, Darko, et al., U.S. Appl. No. 16/861,686 entitled "Mechanical Locking of Floor Panels with a Flexible Bristle Tongue," filed in the U.S. Patent and Trademark Office on Apr. 29, 2020.
Pervan, Darko, U.S. Appl. No. 16/908,902 entitled "Mechanical Locking System for Floor Panels," filed in the U.S. Patent and Trademark Office on Jun. 23, 2020.

KNOWN TECHNOLOGY 34
30
34
35
35
30
35
30
34

30
21
32
31
34

30
32
34

30
34

MECHANICAL LOCKING SYSTEM FOR FLOOR PANELS

CROSS REFERENCE TO RELATED APPLICATIONS

The present application is a continuation of U.S. application Ser. No. 15/175,768, filed on Jun. 7, 2015, which is a continuation of U.S. application Ser. No. 14/701,959, filed on May 1, 2015, now U.S. Pat. No. 9,388,584, which is a continuation of U.S. application Ser. No. 14/483,352, filed on Sep. 11, 2014, now U.S. Pat. No. 9,051,738, which is a continuation of U.S. application Ser. No. 13/585,179, filed on Aug. 14, 2012, now U.S. Pat. No. 8,857,126, which claims the benefit of U.S. Provisional Application No. 61/523,584, filed on Aug. 15, 2011. The entire contents of each of U.S. application Ser. No. 15/175,768, U.S. application Ser. No. 14/701,959, U.S. application Ser. No. 14/483,352, U.S. application Ser. No. 13/585,179, and U.S. Provisional Application No. 61/523,584 are hereby incorporated herein by reference in their entirety.

TECHNICAL FIELD

The disclosure generally relates to the field of mechanical locking systems for floor panels and building panels and production methods to insert a tongue into a groove.

FIELD OF APPLICATION

Embodiments of the present disclosure are particularly suitable for use in floating floors, which are formed of floor panels which are joined mechanically with a locking system integrated with the floor panel, i.e. mounted at the factory, are made up of one or more upper layers of wood or wood veneer, decorative laminate, powder based surfaces or decorative plastic material, an intermediate core of wood-fibre-based material or plastic material and preferably a lower balancing layer on the rear side of the core. Floor panels with a surface layer of cork, linoleum, rubber or soft wear layers, for instance needle felt glued to a board, printed and preferably also varnished surface and floors with hard surfaces such as stone, tile and similar materials are included. Embodiments of the disclosure may also be used for joining building panels which preferably contain a board material for instance wall panels, ceilings, furniture components and similar.

The following description of known technique, problems of known systems and objects and features of the disclosure will therefore, as a non-restrictive example, be aimed above all at this field of application and in particular at panels formed as rectangular floor panels with long and shorts edges intended to be mechanically joined to each other on both long and short edges.

The long and short edges are mainly used to simplify the description of embodiments of the disclosure. The panels may be square. Embodiments of the disclosure are preferably used on the short edges. It should be emphasized that embodiments of the disclosure may be used in any floor panel and it may be combined with all types of known locking system formed on the long edges, where the floor panels are intended to be joined using a mechanical locking system connecting the panels in the horizontal and vertical directions on at least two adjacent sides.

BACKGROUND

Laminate flooring usually comprise a core of a 6-12 mm fibre board, a 0.2-0.8 mm thick upper decorative surface layer of laminate and a 0.1-0.6 mm thick lower balancing layer of laminate, plastic, paper or like material. A laminate surface comprises melamine-impregnated paper. The most common core material is fibreboard with high density and good stability usually called HDF—High Density Fibreboard. Sometimes also MDF—Medium Density Fibreboard—is used as core.

Laminate floorings are joined mechanically by means of so-called mechanical locking systems. These systems comprise locking means, which lock the panels horizontally and vertically. The mechanical locking systems are usually formed by machining of the core of the panel. Alternatively, parts of the locking system may be formed of a separate material, for instance aluminum or HDF, which is integrated with the floor panel, i.e. joined with the floor panel in connection with the manufacture thereof.

The main advantages of floating floors with mechanical locking systems are that they are easy to install. They may also easily be taken up again and used once more at a different location.

Definition of Some Terms

In the following text, the visible surface of the installed floor panel is called "front side", while the opposite side of the floor panel, facing the sub floor, is called "rear side". The edge between the front and rear side is called "joint edge". By "horizontal plane" is meant a plane, which extends parallel to the outer part of the surface layer. Immediately juxtaposed upper parts of two adjacent joint edges of two joined floor panels together define a "vertical plane" perpendicular to the horizontal plane. By "vertical locking" is meant locking parallel to the vertical plan. By "horizontal locking" is meant locking parallel to the horizontal plane.

By "up" is meant towards the front side, by "down" towards the rear side, by "inwardly" mainly horizontally towards an inner and center part of the panel and by "outwardly" mainly horizontally away from the center part of the panel.

By "locking systems" are meant co acting connecting elements, which connect the floor panels vertically and/or horizontally.

Related Art and Problems Thereof

For mechanical joining of long edges as well as short edges in the vertical and in the first horizontal direction perpendicular to the edges several methods may be used. One of the most used methods is the angle-snap method. The long edges are installed by angling. The panel is than displaced in locked position along the long side. The short edges are locked by horizontal snapping. The vertical connection is generally a tongue and a groove. During the horizontal displacement, a strip with a locking element is bent and when the edges are in contact, the strip springs back and a locking element enters a locking groove and locks the panels horizontally. Such a snap connection is complicated since a hammer and a tapping block may need to be used to overcome the friction between the long edges and to bend the strip during the snapping action.

Similar locking systems may also be produced with a rigid strip and they are connected with an angling-angling method where both short and long edges are angled into a locked position.

Recently new and very efficient locking systems have been introduced with a separate flexible or displaceable integrated tongue on the short edge that allows installation with only an angling action, generally referred to as "vertical folding". Such a system is described in WO 2006/043893 (Välinge Innovation AB).

Several versions are used on the market. One of the most used versions is shown in FIGS. 1*a*-1*d*. A flexible tongue 30 is during locking displaced in a horizontally extending displacement groove 40 and into a tongue groove 20 of an adjacent panel. The displaceable tongue locks the edges vertically and a strip 6 with a locking element that cooperates with a locking groove 14 locks the panels horizontally. The locking is a combination of vertical displacement and turning similar to a scissor action. The tongue is gradually displaced inwardly during locking from one inner edge to an outer edge as shown in FIG. 1*d* such that the tongue is bent in the length direction. Such systems are referred to as vertical snap systems and they provide an automatically locking during the folding action.

Although such systems are very efficient, there is still a room for improvements.

High locking force can only be accomplished with high snapping resistance when the tongue is pressed inwardly and bent in the length direction. This creates separation forces that tend to push the panels apart during folding. The locking may lose its strength if the flexibility and pressing force of the tongue decreases over time.

The flexibility must be considerable and allow that a flexible tongue is displaced in two directions about 1-2 mm. The material, which is used to produce such tongues, is rather expensive and glass fibres are generally used to reinforce the flexible tongue.

It would be a major advantage if snapping could be eliminated in a system that locks automatically during folding.

SUMMARY AND OBJECTS

An overall objective of embodiments of the present disclosure is to provide a locking system for primarily rectangular floor panels with long and short edges installed in parallel rows, which allows that the short edges may be locked to each other automatically without a snap action that creates a locking resistance and separation forces of the short edges during folding.

A specific objective is to provide a locking system with a separate displaceable tongue that may be bent in length direction with a lower separation force and that comprises means that prevent the tongue to slide back into the groove after locking.

The above objects of embodiments of the disclosure may be achieved wholly or partly by locking systems and floor panels according to the disclosure. Embodiments of the disclosure are evident from the description and drawings.

An aspect of the disclosure is building panels provided with a locking system for vertical locking of a first and a second building panel by a vertical displacement of the panels relative each other. A displaceable tongue is attached into a sidewardly open displacement groove provided at an edge of the first panel. Said tongue cooperates with a tongue groove provided at an adjacent edge of the second panel for locking the edges vertically. A strip protrudes below the displacement groove and outwardly beyond the upper part of the edge or below the tongue groove and outwardly beyond the upper part of the adjacent edge. The displaceable tongue comprises a pulling extension at its outer part configured to cooperate with a pulling protrusion formed at an edge of the adjacent panel such that the displaceable tongue is pulled out from the displacement groove and into the tongue groove when the edges of the panels are displaced vertically against each other.

Said pulling protrusion may be part of the tongue groove.

The pulling extension may be inclined in relation to a main horizontal plane of the panels.

The pulling protrusion may be inclined in relation to a main horizontal plane of the panels.

The displaceable tongue may be provided with a locking hook that prevents the tongue to slide back into the displacement groove after locking.

The locking hook may lock against an outer part of the displacement groove.

BRIEF DESCRIPTION OF THE DRAWINGS

The disclosure will in the following be described in connection to exemplary embodiments and in greater detail with reference to the appended exemplary drawings, wherein.

DETAILED DESCRIPTION OF EMBODIMENTS

To facilitate understanding, several locking systems in the figures are shown schematically. It should be emphasized that improved or different functions may be achieved using combinations of the embodiments.

All embodiments may be used separately or in combinations. Angles, dimensions, rounded parts, spaces between surfaces etc. are only examples that may be adjusted within the basic principles of the disclosure.

Figure 1A:
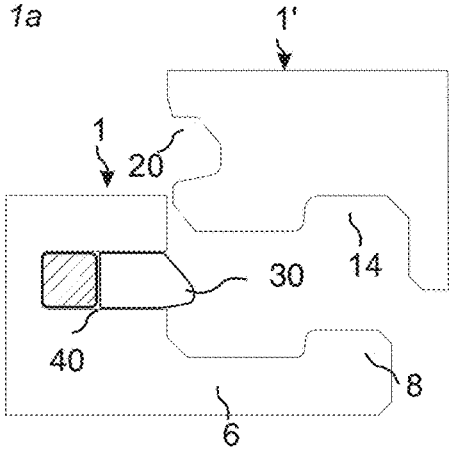
FIGS. 1*a*-1*d* illustrate locking systems according to known technology.
Figure 1B:
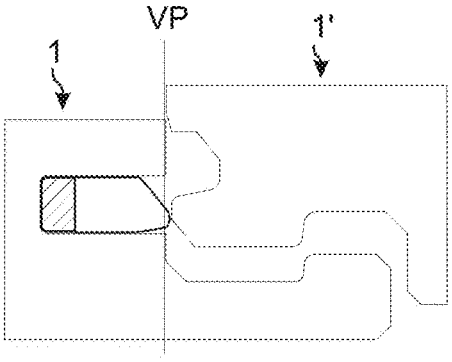
Figure 1C:
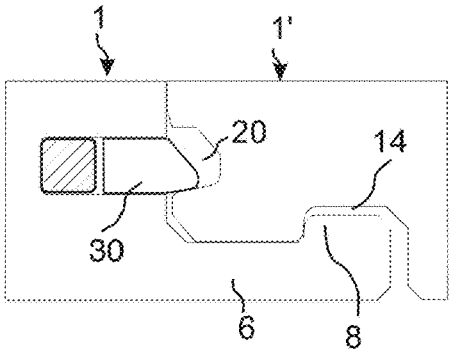
Figure 1D:
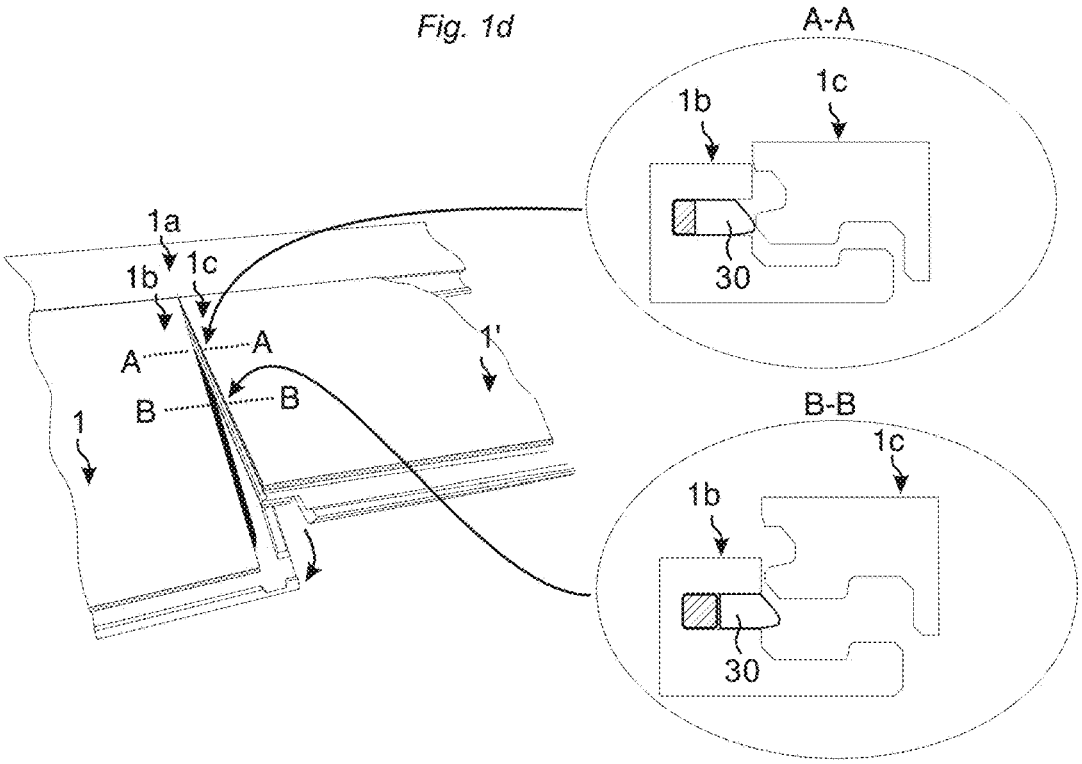
Figure 2A:
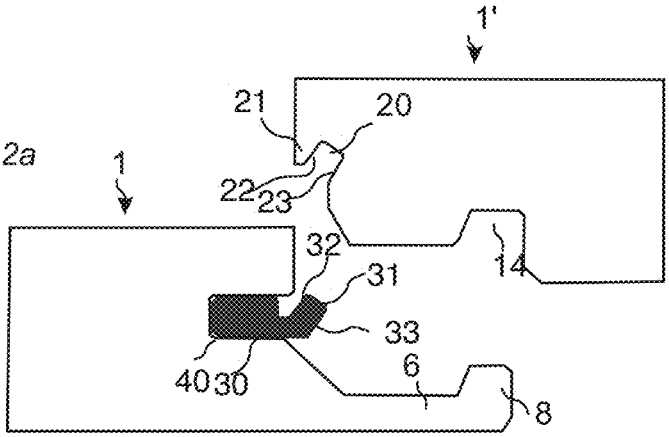
FIGS. 2*a*-2*e* illustrate a short edge locking system according to the disclosure.
Figure 2B:
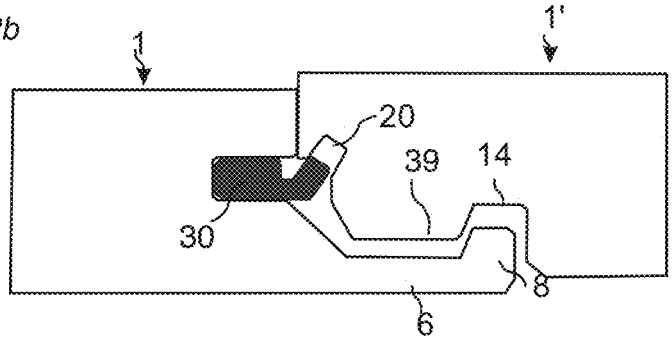
Figure 2C:
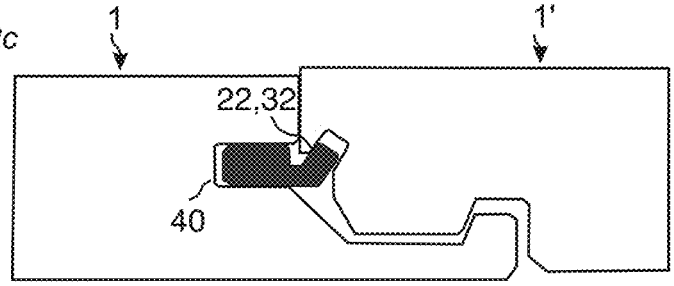
Figure 2D:
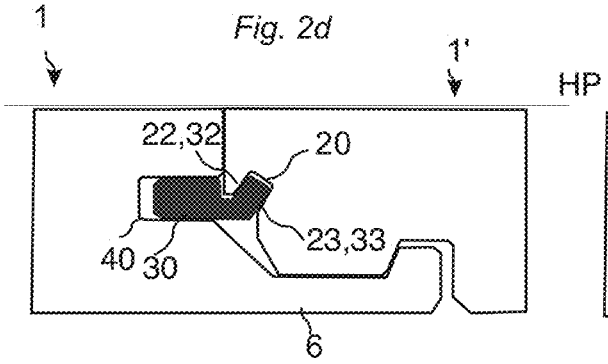
Figure 2E:
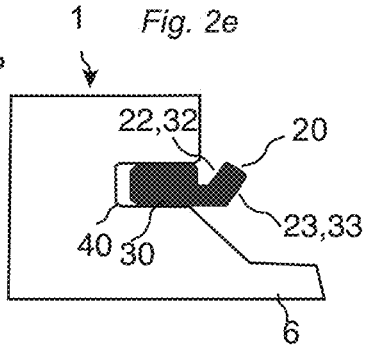

FIGS. 2*a*-2*e* show a first preferred embodiment of a short edge locking system provided with a flexible and displaceable tongue 30 in an edge of a first panel 1 inserted in a horizontally extending displacement groove 40. The displaceable tongue 30 has a pulling extension 31 comprising a tongue pulling surface 32 and tongue locking surface 33. The second adjacent panel 1' has a pulling protrusion 21 with a groove pulling surface 22 that is also a part of a tongue groove 20 comprising a groove locking surface 23. The pulling surfaces 22, 32 cooperate during the vertical displacement and pull the displaceable tongue 30 into a tongue groove 20. The pulling extension 31 comprises a tongue locking surface 33 that locks against a groove locking surface 23 and prevents vertical displacement of the edges in a first vertical direction. A locking strip 6 and a lower part 39 of the adjacent panel locks the edges in a second vertical direction. A locking element 8 and a locking groove 14 locks the edges horizontally together with the upper edges. The vertical connection may be used without the horizontal locking as shown by FIG. 2*e*. Short edges may be locked horizontally by, for example, friction between long edges.

Figure 3A:
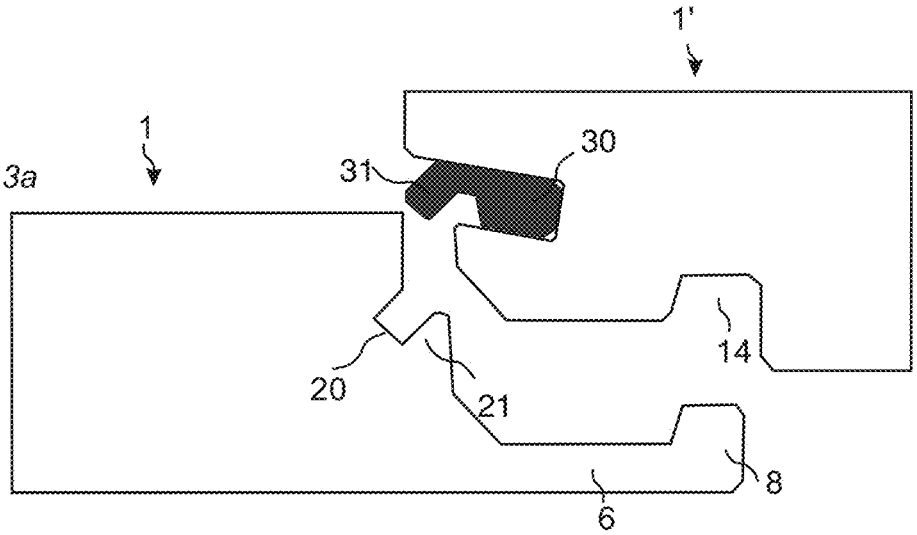
FIGS. 3*a*-3*c* illustrate a short edge locking system according to preferred embodiments of the disclosure.
Figure 3B:
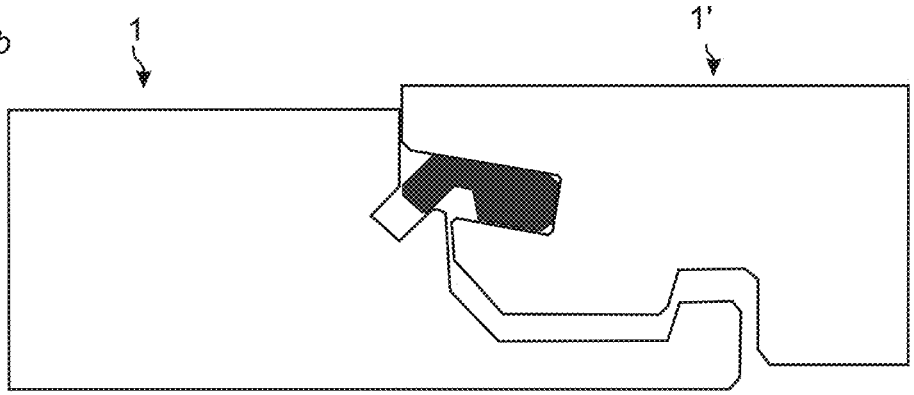
Figure 3C:
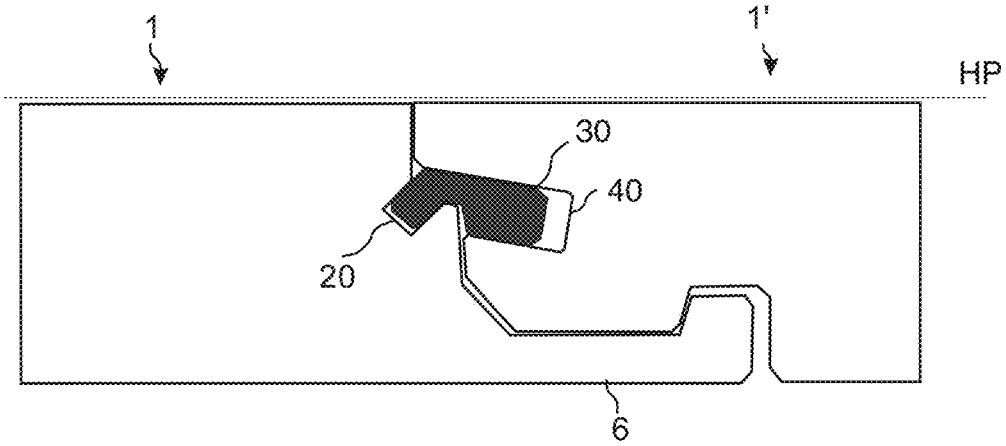

The tongue may be attached into a displacement groove 40 formed on the panel comprising the strip 6, the strip panel, or on the panel comprising the locking groove, the groove panel, as shown in FIGS. 3*a*-3*c*. The pulling protrusion 21 may extend upwardly or downwardly and the displacement groove may be inclined against the horizontal plane HP.

Figure 4A:
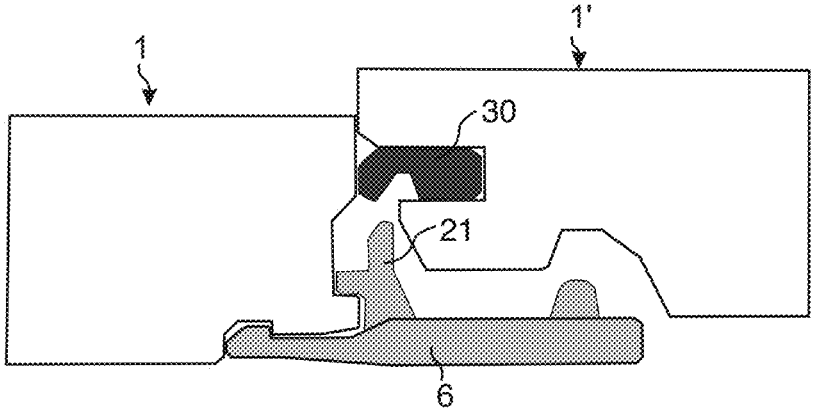
FIGS. 4*a*-4*c* illustrate preferred embodiments of short edge locking systems with a separate strip.
Figure 4B:
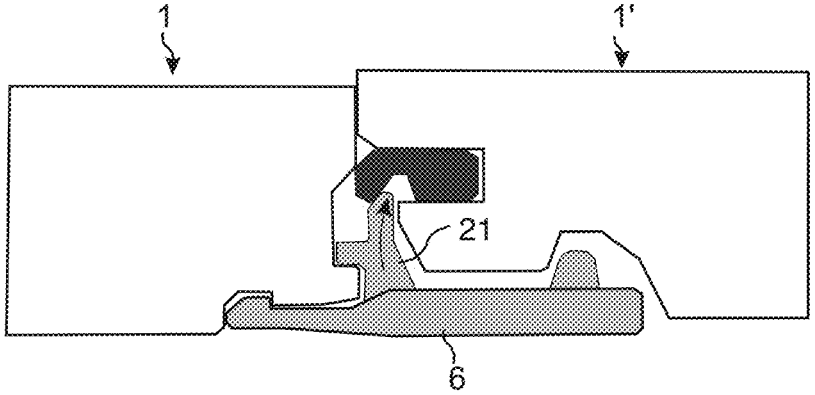
Figure 4C:
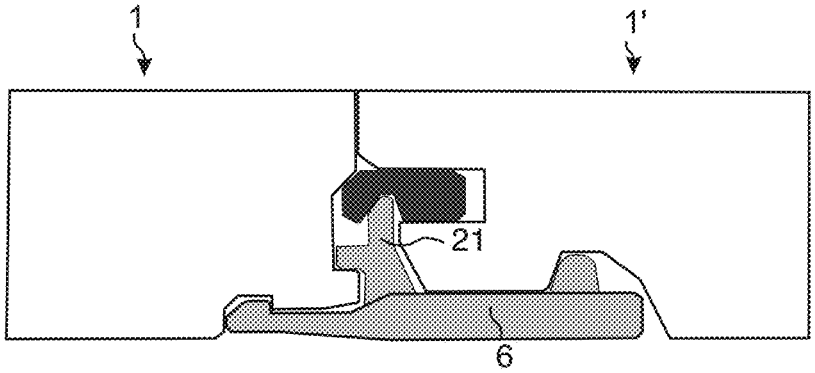

FIGS. 4*a*-4*c* show that the strip 6 may be formed as a separate material. The pulling protrusion 21 may be flexible and this may eliminate production tolerances and facilitate the displacement of the tongue 30 into the tongue groove 20 during folding.

Figure 5A:
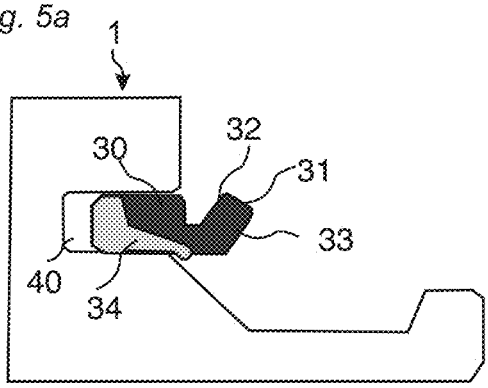
FIGS. 5*a*-5*e* illustrate a locking system according to an embodiment of the disclosure with a locking hook that prevents unlocking.
Figure 5B:
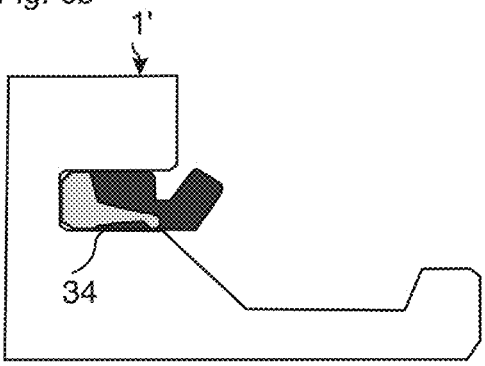
Figure 5C:
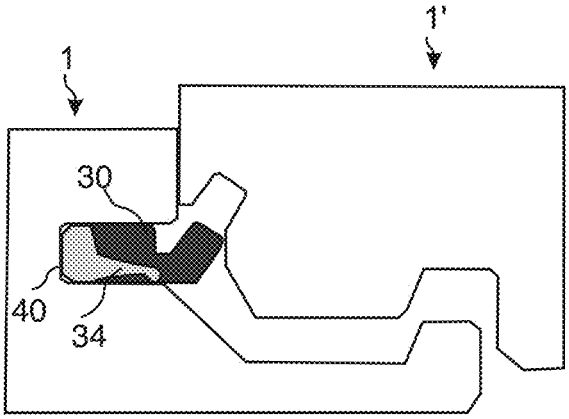
Figure 5D:
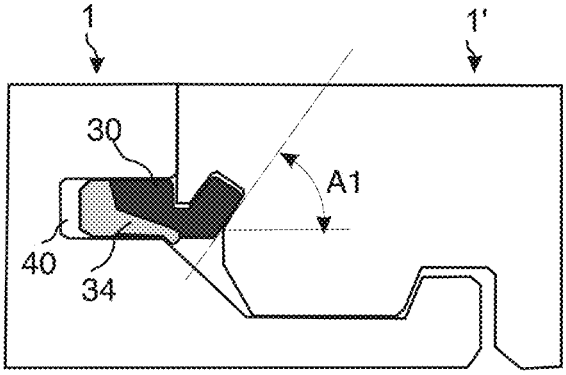
Figure 5E:
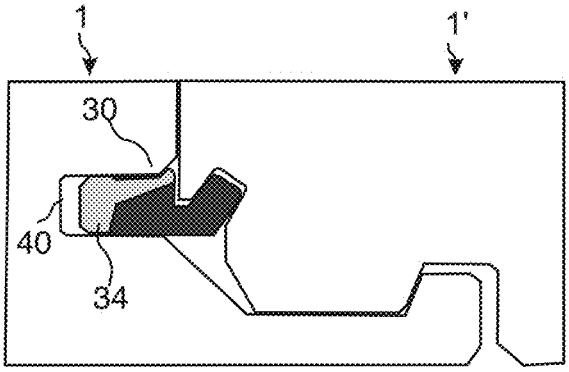

FIGS. 5*a*-5*e* show that the displaceable tongue 30 may comprise a locking hook 34 that may serve as a friction connection to prevent the tongue 30 from falling out from the groove 40 but also to prevent the tongue from sliding back after locking. The locking angle A1 is preferably about 45 degrees or higher. A higher angle facilitates displacement into the tongue groove 20 but also backward displacement. This may be prevented by a hook connection 34 that preferably locks against an upper or lower part of the displacement groove 40. The hook connection is pressed into the groove by a hammer that inserts the tongue 30 into the groove 40 during production. The hook 34 slides against a bevel formed at the displacement groove 40 as shown in FIG. 5*c*. The upper part of the locking element 8 is preferably located vertically below the tongue locking surface 33 as shown in FIG. 5*d*. This gives a stronger locking. The locking system may have a geometry that allows locking and unlocking with angling.

Figures 6A, 6B, 6C, 6D:
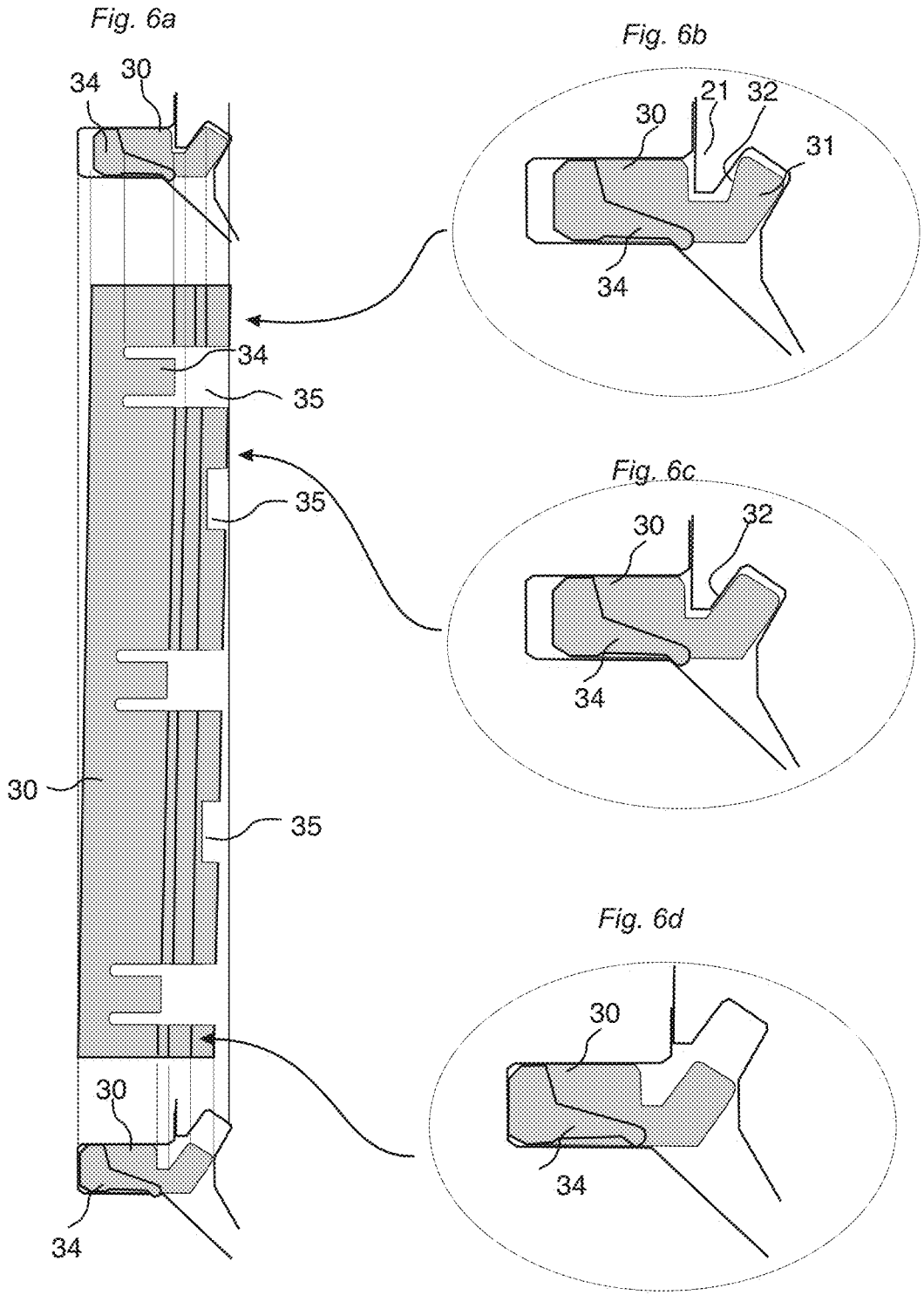
FIGS. 6*a*-6*d* illustrate a tongue according to an embodiment of the disclosure with increased flexibility related to bending in length direction.
Figure 7A:
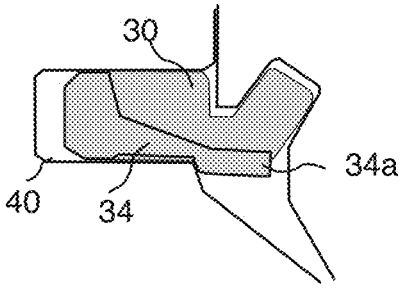
FIGS. 7*a*-7*d* illustrate a method according to an embodiment of the disclosure to insert a tongue into a groove.
Figure 7B:
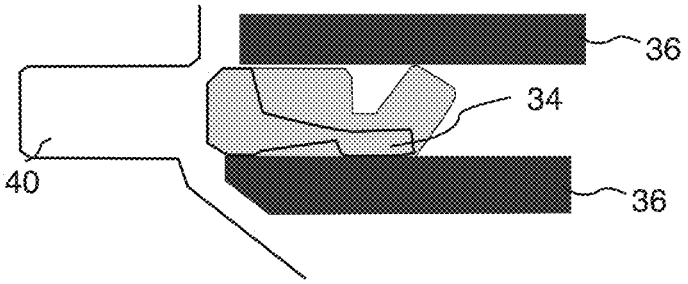
Figure 7C:
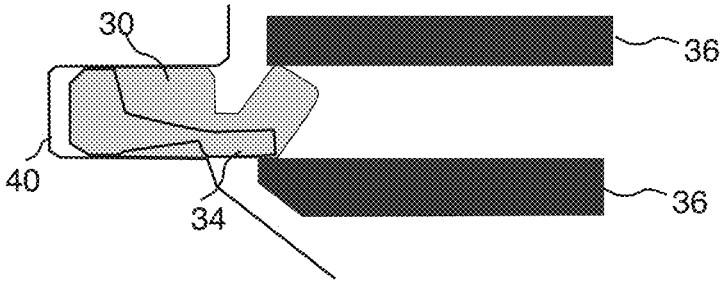
Figure 7D:
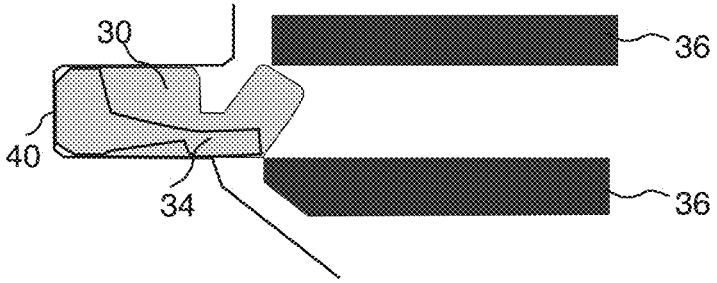

FIGS. 6*a*-6*c* show that the displaceable tongue 30 turns and bends in the length direction during folding when an inner short edge of the tongue, as shown in FIG. 6*b* is in locked position and an outer short edge of the tongue 30 is in unlocked position as shown in FIG. 6*d*. The locking function may be improved if cavities 35 are formed on the displaceable tongue 30. Locking may also be improved if the locking surface 32 at an edge has a lower angle than at an inner part as shown in FIGS. 6*b* and 6*c*. The cavities 35 may be formed at tongue section where the locking hooks 34 are formed. The displaceable tongue 30 comprises preferably a polymer material and is preferably formed by injection molding.

FIGS. 7*a*-7*d* show that the locking hook 34 may comprise a hook part 34*a* that is used to press the hook connection upwards by inserting rails 36 during the insertion of the tongue into the displacement groove 40.

Figure 8A:
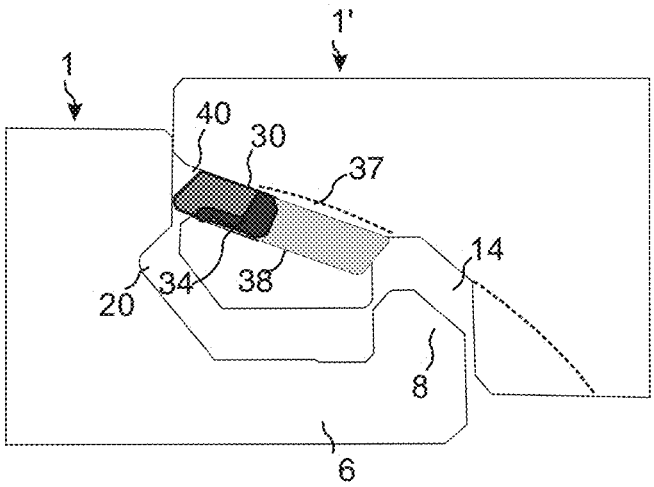
FIGS. 8*a*-8*c* illustrate an embodiment of the disclosure.
Figure 8B:
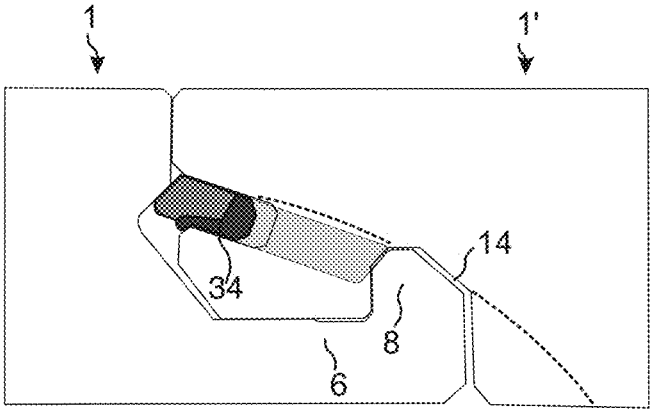
Figure 8C:
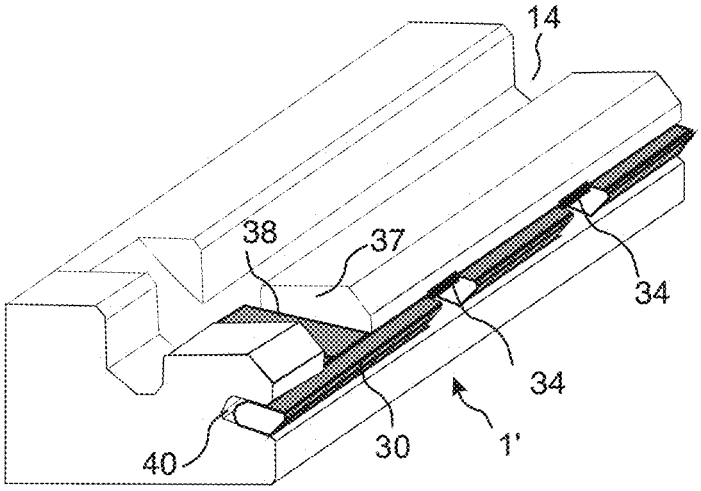

FIGS. 8*a*-8*c* show that the locking hook 34 may be used to prevent unlocking in any locking system where a tongue is displace in a groove from an inner position to an outer position. The shown locking system comprises pushing protrusions 38 located in pushing cavities 37. The pushing protrusions slide against the locking element 8 and push the tongue 30 into a tongue groove 20. The locking element 8 is preferably located vertically below the cooperating locking surfaces 23,33 of the tongue 30 and the tongue groove 20.

The invention claimed is:

1. A displaceable tongue for locking an edge of a first building panel and an adjacent edge of a second building panel vertically, the displaceable tongue being configured to be arranged in a sidewardly open displacement groove provided at an edge of the first building panel, wherein the displaceable tongue has a longitudinal extent and a transverse extent, said longitudinal extent being larger that said transverse extent, wherein the displaceable tongue comprises a pulling extension at a transversely outer portion of the displaceable tongue, the pulling extension being configured to cooperate with a pulling protrusion formed at the adjacent edge of the second building panel such that the displaceable tongue is pulled out from the sidewardly open displacement groove and into a tongue groove provided at the adjacent edge of the second building panel when the edge of the first building panel and the edge of the second building panel are displaced vertically relative to each other; and wherein the displaceable tongue comprises a locking hook, and further comprises a cavity formed at a tongue section of the displaceable tongue, wherein the locking hook protrudes into the cavity.

2. The displaceable tongue of claim 1, wherein the locking hook is configured to serve as a friction connection.

3. The displaceable tongue of claim 1, wherein the locking hook is configured to prevent the displaceable tongue from falling out from the displacement groove after locking of the building panels.

4. The displaceable tongue of claim 1, wherein the locking hook is configured to prevent the displaceable tongue from sliding back into the displacement groove after locking of the building panels.

5. The displaceable tongue of claim 1, wherein the locking hook is configured to lock against an upper or lower part of the displacement groove.

6. The displaceable tongue of claim 1, wherein the locking hook is configured to slide against a bevel formed at the displacement groove.

7. The displaceable tongue of claim 1, wherein the locking hook is configured to lock against an outer portion of the sidewardly open displacement groove.

8. The displaceable tongue of claim 1, wherein the locking hook comprises a hook part configured to press the hook connection upwards by rails during an insertion of the displaceable tongue into the displaceable groove.

9. The displaceable tongue of claim 1, wherein the cavity is formed in the pulling extension.

10. The displaceable tongue of claim 1, wherein the displaceable tongue comprises a polymer material.

11. The displaceable tongue of claim 1, wherein the displaceable tongue is formed by injection moulding.

12. The displaceable tongue of claim 1, wherein the pulling protrusion is inclined in relation to a main horizontal plane of the first and second building panels when the displaceable tongue is arranged in the sidewardly open displacement groove.

13. The displaceable tongue of claim 1, wherein the pulling extension has a constant thickness.

14. The displaceable tongue of claim 1, wherein the pulling extension increases in thickness in a direction toward an outermost portion of the pulling extension.

15. The displaceable tongue of claim 1, comprising a plurality of pulling extensions at the transversely outer portion of the displaceable tongue.

16. The displaceable tongue of claim 1, wherein displaceable tongue is bendable in a longitudinal direction of the displaceable tongue.

17. The displaceable tongue of claim 1, wherein the pulling extension extends upwards when the displaceable tongue is arranged in the sidewardly open displacement groove.

* * * * *